US010045585B2

(12) United States Patent
Pedersen et al.

(10) Patent No.: US 10,045,585 B2
(45) **Date of Patent: *Aug. 14, 2018**

(54) ORTHOTIC INSOLE FOR FOOTWEAR WITH AN ATTACHABLE ANGLE INSERT FOR CORRECTING OVER PRONATION OR SUPINATION OF A FOOT

(71) Applicant: IDEAL LIVING VENTURES LIMITED, Hong Kong (CN)

(72) Inventors: Michael Pedersen, Valley Glen, CA (US); Peter Spiegel, Sherman Oaks, CA (US); Babak Baravarian, Santa Monica, CA (US)

(73) Assignee: IDEAL LIVING VENTURES LIMITED, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/584,470

(22) Filed: May 2, 2017

(65) Prior Publication Data

US 2017/0231318 A1 Aug. 17, 2017

Related U.S. Application Data

(63) Continuation of application No. 14/792,751, filed on Jul. 7, 2015, now Pat. No. 9,668,537.

(51) Int. Cl.

| | |
|---|---|
| ***A43B 17/02*** | (2006.01) |
| ***A43B 7/24*** | (2006.01) |
| ***A43B 7/14*** | (2006.01) |

(52) U.S. Cl.

CPC ..... *A43B 7/24* (2013.01); *A43B 7/141* (2013.01); *A43B 7/142* (2013.01); *A43B 7/143* (2013.01); *A43B 7/144* (2013.01); *A43B 7/148* (2013.01); *A43B 7/149* (2013.01); *A43B 7/1465* (2013.01); *A43B 17/023* (2013.01)

(58) Field of Classification Search

CPC ..... A43B 7/24; A43B 7/1465; A43B 7/148; A43B 7/149; A43B 7/28; A43B 17/023

USPC ..... 36/143, 144

See application file for complete search history.

(56) References Cited

U.S. PATENT DOCUMENTS

| | | | |
|---|---|---|---|
| 1,958,097 | A | 5/1934 | Shaw |
| 3,780,742 | A | 12/1973 | Madgy |
| 5,345,701 | A | 9/1994 | Smith |

(Continued)

FOREIGN PATENT DOCUMENTS

| | | |
|---|---|---|
| TW | M365165 U1 | 9/2009 |

OTHER PUBLICATIONS

PCT Written Opinion of the International Searching Authority for International Application No. PCT/1B2015/002316, dated Mar. 22, 2016.

*Primary Examiner* — Ted Kavanaugh

(74) *Attorney, Agent, or Firm* — Eversheds Sutherland (US) LLP

(57) ABSTRACT

An orthotic device for insertion into footwear for correcting over pronation or supination of a foot is disclosed herein. The orthotic device may include an insole comprising an upper surface and a lower surface. The upper surface of the insole may receive and support at least a portion of the foot. The orthotic device also may include a removable angle insert attachable to the lower surface of the insole. The removable angle insert may increase an angle about a side of the insole to correct over pronation or supination of the foot.

16 Claims, 6 Drawing Sheets

(56) References Cited

U.S. PATENT DOCUMENTS

| | | | | |
|---|---|---|---|---|
| 6,098,319 | A | 8/2000 | Epstein | |
| 6,460,275 | B1 | 10/2002 | Bennett et al. | |
| 7,913,429 | B1 | 3/2011 | Wert | |
| 9,668,537 | B2 * | 6/2017 | Pedersen | A43B 7/24 |
| 2002/0007569 | A1 | 1/2002 | Crane et al. | |
| 2006/0000120 | A1 | 1/2006 | Chenut et al. | |
| 2006/0059726 | A1 | 3/2006 | Song et al. | |
| 2006/0242860 | A1 | 11/2006 | Canvin | |
| 2008/0060229 | A1 | 3/2008 | Epstein | |
| 2009/0172972 | A1 | 7/2009 | Rosen | |
| 2015/0342295 | A1 | 12/2015 | Moon | |
| 2015/0359682 | A1 | 12/2015 | Stilwell | |

* cited by examiner

ORTHOTIC INSOLE FOR FOOTWEAR WITH AN ATTACHABLE ANGLE INSERT FOR CORRECTING OVER PRONATION OR SUPINATION OF A FOOT

CROSS-REFERENCE TO RELATED APPLICATIONS

The disclosure claims priority to and the benefit of U.S. patent application Ser. No. 14/792,751, filed Jul. 7, 2015, which is incorporated by reference herein in its entirety.

FIELD OF THE DISCLOSURE

The disclosure generally relates to orthotic devices and more particularly relates to an insole for footwear with an attachable angle insert for adjusting an angle of the insole to correct over pronation or supination of a foot.

BACKGROUND

An abnormally pronated foot is a common problem. A pronated foot disrupts the normal path of weight bearing and causes exaggerated internal rotation of the leg. Over pronation of the foot is undesirable and may cause discomfort and injury. Supination is the opposite of pronation and refers to the outward roll of the foot. Common maladies resulting from over pronation and supination of the foot include, among others, arch pain, heel pain, flat feet, knee pain, ankle sprains, tendinitis, joint pain, back pain, shin splints, and/or stress fractures.

SUMMARY

Some or all of the above needs and/or problems may be addressed by certain embodiments of an orthotic device for insertion into footwear for correcting over pronation or supination of a foot. The orthotic device may include an insole comprising an upper surface and a lower surface. The upper surface of the insole may receive and support at least a portion of the foot. The orthotic device also may include a removable angle insert attachable to the lower surface of the insole. The removable angle insert may increase an angle about a side of the insole to correct over pronation or supination of the foot.

Other features and aspects of the orthotic device will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
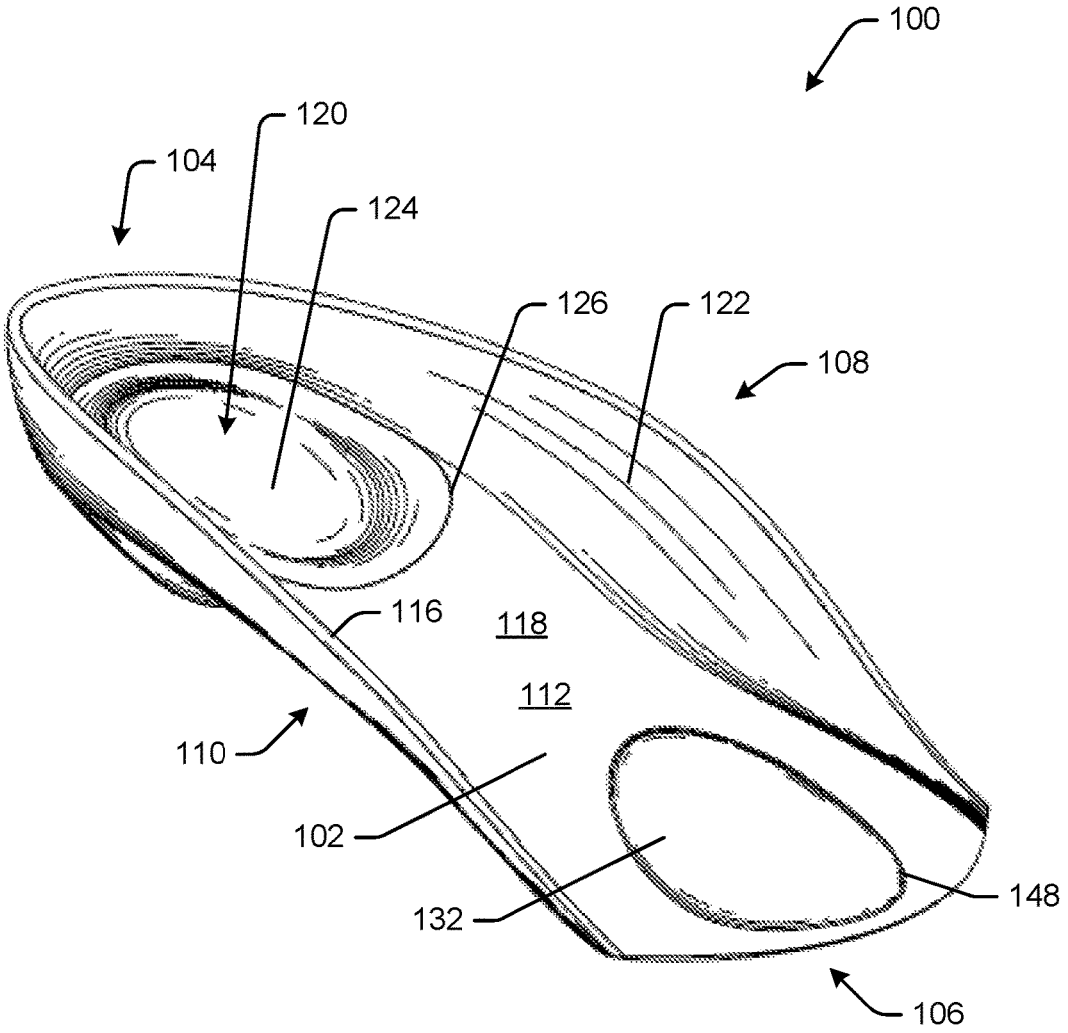
FIG. 1 schematically depicts an upper view of an orthotic device in accordance with one or more embodiments of the disclosure.
Figure 2:
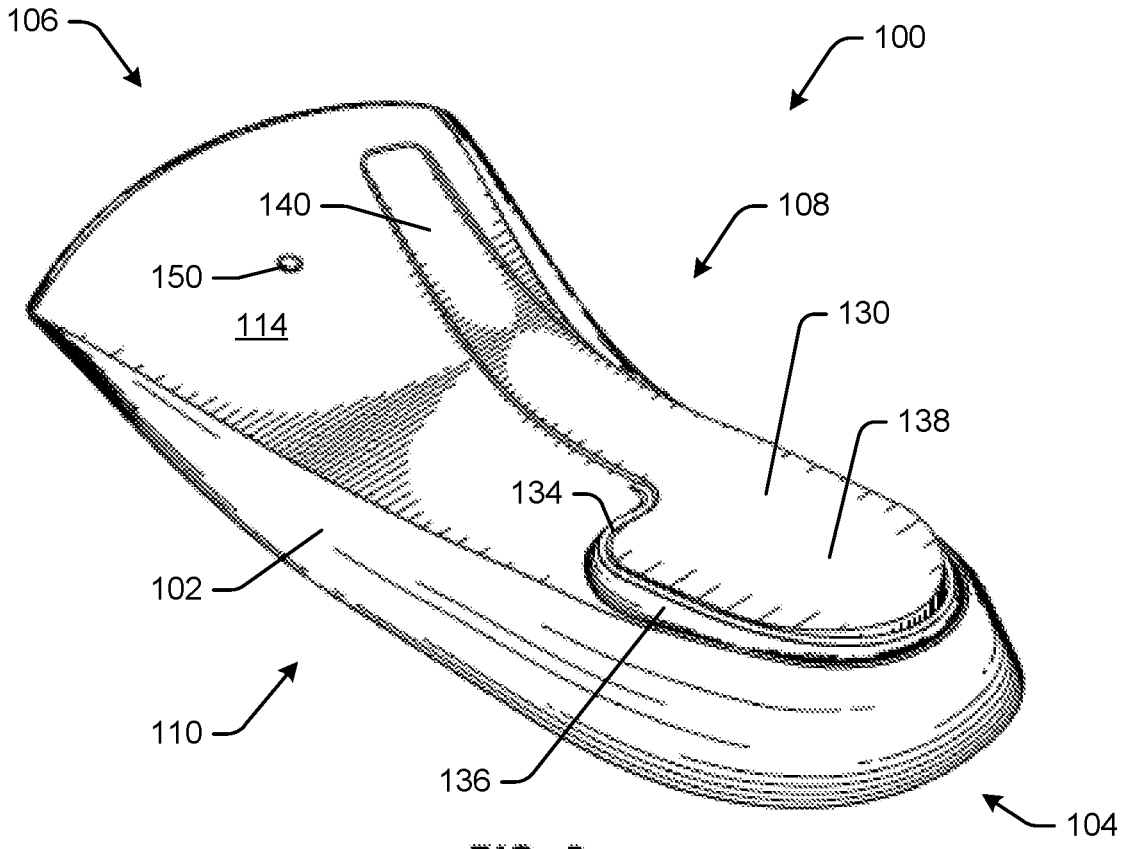
FIG. 2 schematically depicts a lower view of an orthotic device in accordance with one or more embodiments of the disclosure.
Figure 3:
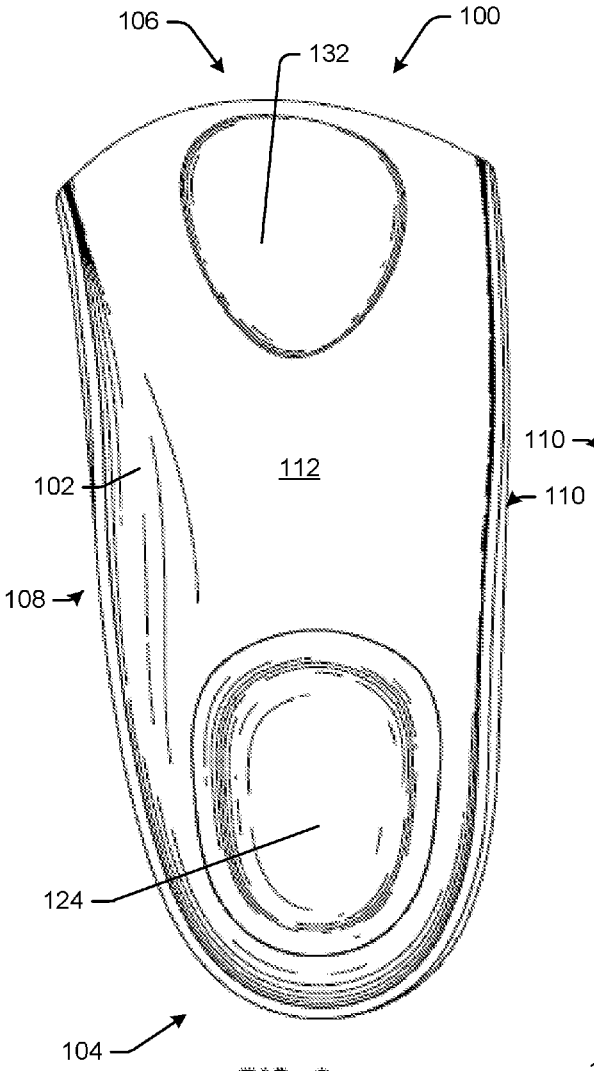
FIG. 3 schematically depicts a top view of an orthotic device in accordance with one or more embodiments of the disclosure.
Figure 4:
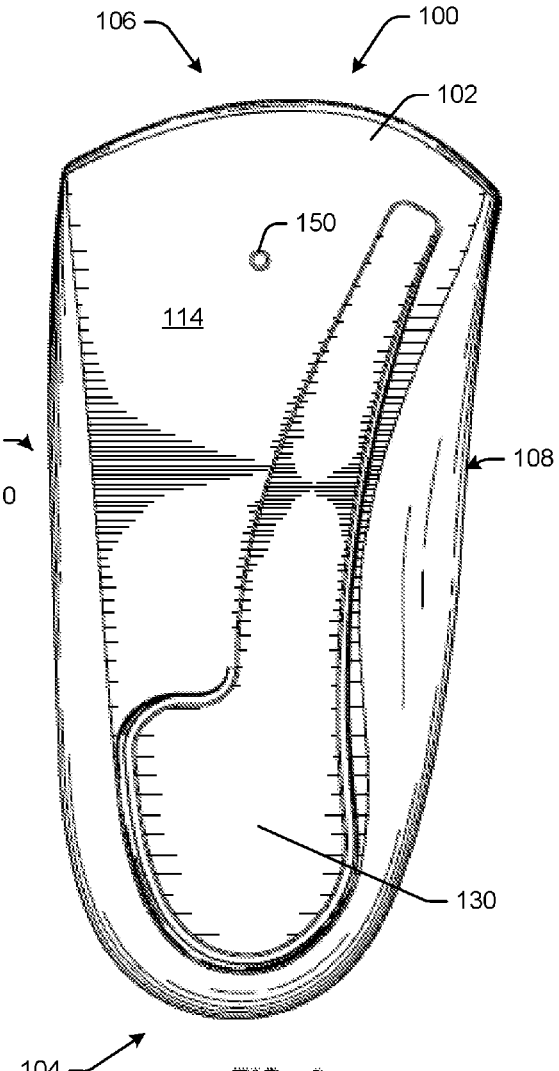
FIG. 4 schematically depicts a bottom view of an orthotic device in accordance with one or more embodiments of the disclosure.
Figure 5:
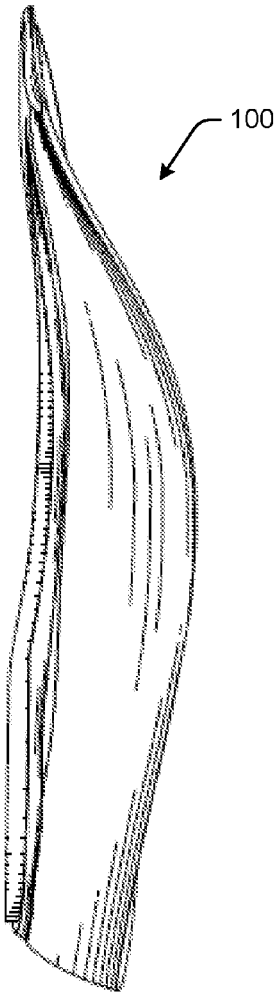
FIG. 5 schematically depicts a side view of an orthotic device in accordance with one or more embodiments of the disclosure.
Figure 6:
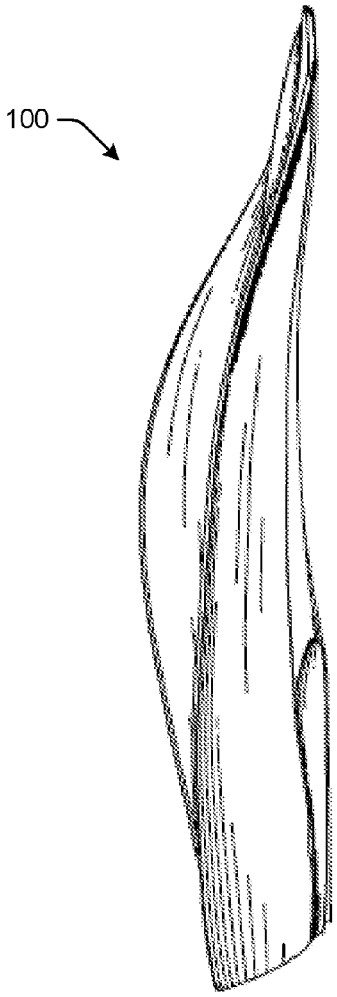
FIG. 6 schematically depicts a side view of an orthotic device in accordance with one or more embodiments of the disclosure.
Figure 7:
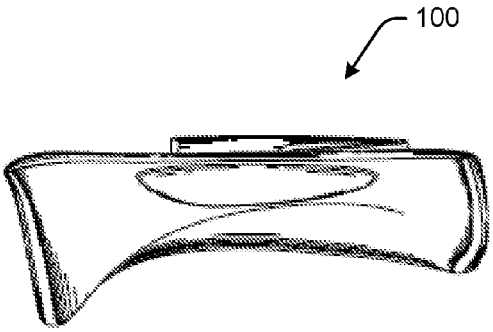
FIG. 7 schematically depicts a front view of an orthotic device in accordance with one or more embodiments of the disclosure.
Figure 8:
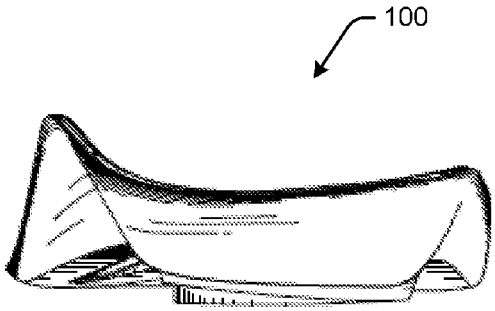
FIG. 8 schematically depicts a back view of an orthotic device in accordance with one or more embodiments of the disclosure.
Figure 9:
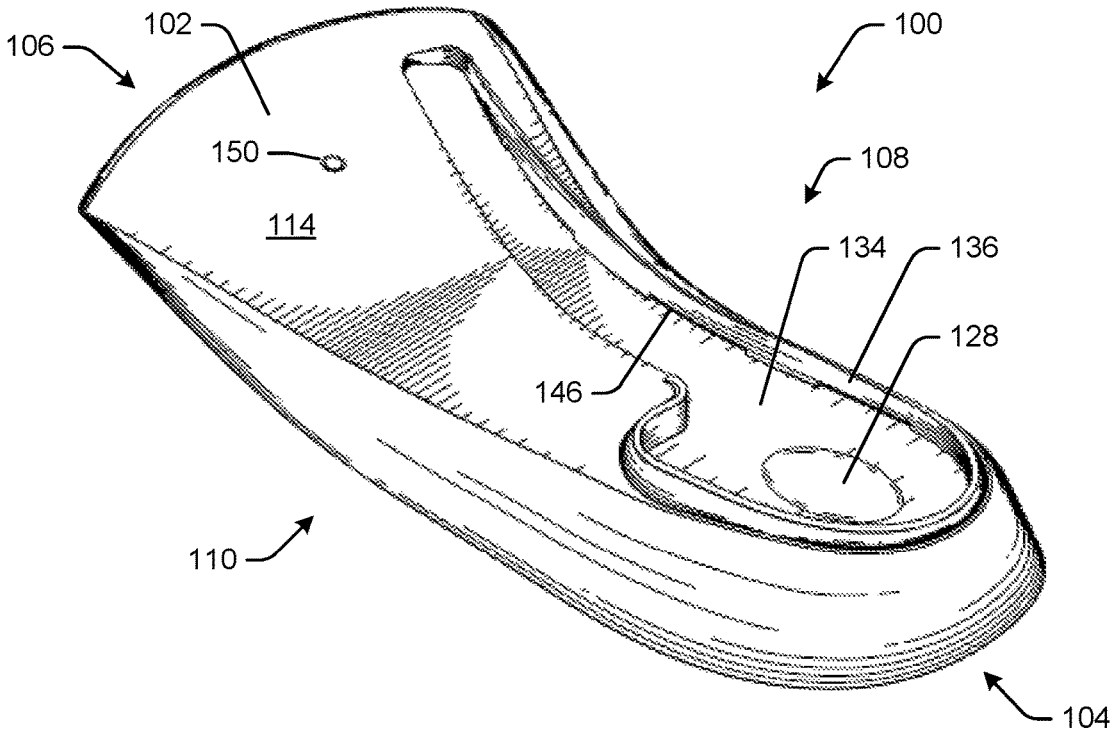
FIG. 9 schematically depicts a lower view of an orthotic device in accordance with one or more embodiments of the disclosure.
Figure 10:
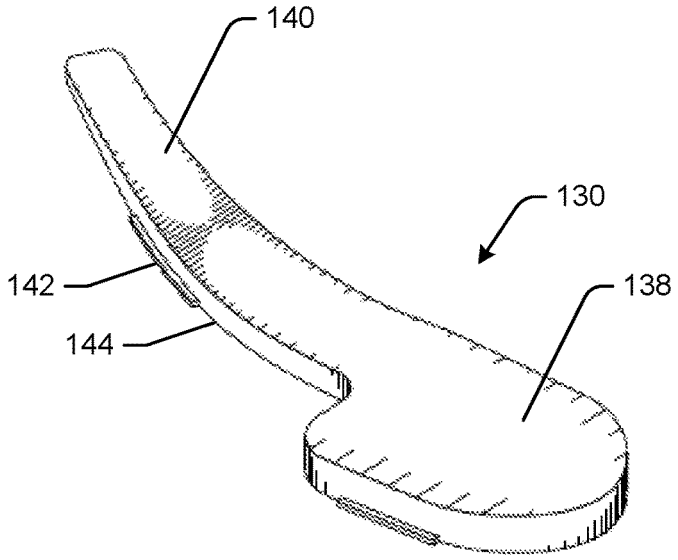
FIG. 10 schematically depicts a lower view of an angle insert in accordance with one or more embodiments of the disclosure.

Described below are embodiments of an orthotic device for insertion into footwear for correcting over pronation or supination of a foot. The orthotic device may include an insole comprising a first end, a second end, a first side, a second side, an upper surface, and a lower surface. The upper surface of the insole may be configured to receive and support at least a portion of the foot. The orthotic device also may include a removable angle insert attachable to the lower surface of the insole. For pronation, the removable angle insert may increase an angle about the first side of the insole on a medial side of the foot to correct over pronation of the foot. For supination, the removable angle insert may increase an angle about the second side of the insole on a lateral side of the foot to correct over supination of the foot.

In some instances, the removable angle insert may increase the angle about the first side of the insole on the medial side of the foot between about 0 to 10 degrees to correct over pronation of the foot. The removable angle insert may increase the angle about the first side of the insole any amount (including those greater than 10 degrees) to correct over pronation of the foot. For example, a number of angle inserts may provide varying angles about the first side of the insole on the medial side of the foot to correct over pronation of the foot. In this manner, depending on the needs of a user, the angle inserts may be swapped out with other angle inserts to achieve a desired angle to correct over pronation of the foot. That is, a user may customize the orthotic device to correct over pronation of the foot.

In other instances, the removable angle insert may increase the angle about the second side of the insole on the lateral side of the foot between about 0 to 10 degrees to correct over supination of the foot. The removable angle insert may increase the angle about the second side of the insole any amount (including those greater than 10 degrees) to correct over supination of the foot. For example, a number of angle inserts may provide varying angles about the second side of the insole on the lateral side of the foot to correct over supination of the foot. In this manner, depending on the needs of a user, the angle inserts may be swapped out with other angle inserts to achieve a desired angle to correct over supination of the foot. That is, a user may customize the orthotic device to correct over supination of the foot.

The first end of the insole may form a heel support portion having a contoured surface that corresponds to a heel of the foot. Similarly, the first side of the insole may form an arch support portion having a contoured surface that corresponds to an arch of the foot, and the second side of the insole may include one or more edges and surfaces to receive and support the lateral side of the foot. In some instances, the distance from the first end of the insole to the second end of the insole may be about ¾ a length of the foot. In other instances, the insole may extend the entire length of the foot. In some instances, a thickness of the second end of the insole may decrease in a direction away from the heal support portion.

The orthotic device may include a cushion positioned at the first end of the insole and on the upper surface of the insole for cushioning a heel of the foot. In some instances, the upper surface of the insole about the first end of the insole may include a cushion notch. The cushion notch may be sized and shaped to receive the cushion therein. In some instances, the orthotic device may include an opening between the upper surface of the insole and the lower surface of the insole about the first end of the insole. At least a portion of the cushion may be insertable into the opening. In certain embodiments, the cushion may be angled relative to the upper surface of the insole to correct over pronation or supination of the foot.

In some instances, for correcting pronation, the orthotic device may include an insert notch in the lower surface of the insole about the first end of the insole and along the first side of the insole. In other instances, for correcting supination, the insert notch in the lower surface of the insole may be disposed about the first end of the insole and along the second side of the insole. The insert notch may be sized and shaped to at least partially receive the removable angle insert therein. In some instances, a lip may extend at least partially about the insert notch. When positioned on the lower surface of the insole, the removable angle insert may at least partially extend beyond the lip.

The removable angle insert may include a heal portion attachable to the lower surface of the insole about the first end of the insole. Moreover, for pronation, the removable angle insert may include an extension portion that extends from the heal portion and is attachable to the lower surface of the insole along the first side of the insole. For supination, the removable angle insert may include an extension portion that extends from the heal portion and is attachable to the lower surface of the insole along the second side of the insole. In some instances, the extension portion may be curved. Moreover, a contour of the extension portion may correspond to a contour of the lower surface of the insole. In some instances, a thickness of the extension portion may decrease from the heal portion outward. Likewise, a width of the extension portion may decrease from the heal portion outward.

As noted above, the removable angle insert may be attachable to the lower surface of the insole. Any attachment means may be used to removably secure the angle insert to the insole. For example, in an embodiment, one or more protrusions may be disposed along an edge of the removable angle insert. Similarly, one or more slots may be disposed along the lower surface of the insole. The protrusions may be configured to mate with the slots to secure the removable angle insert to the lower surface of the insole.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-10 schematically depict an orthotic device 100 for insertion into footwear for correcting over pronation or supination of a foot. The orthotic device 100 is customizable by a user to adjust an angle to correct (or resist) over pronation or supination of the foot. The orthotic device 100 may include an insole 102. The insole 102 may include a first end 104, a second end 106, a first side 108, a second side 110, an upper surface 112, and a lower surface 114. The upper surface 112 of the insole 102 may be configured to receive and support at least a portion of the foot. For example, the upper surface 112 of the insole 102 may include one or more edges 116 and contoured surfaces 118 such that the foot at least partially nests on the upper surface 112 of the insole 102.

The first end 104 of the insole 102 may form a heel support portion 120 having a contoured surface that corresponds to a heel of the foot. In this manner, the heel of the foot may nest in the heel support portion 120. The heel support portion 120 may be any size or shape to support the heel of the foot. The first side 108 of the insole 102 may form an arch support portion 122 having a contoured surface that corresponds to an arch of the foot. In this manner, the arch of the foot may nest in the arch support portion 122. The arch support portion 122 may be any size or shape to support the arch of the foot. The second side 110 of the insole 102 may include one or more surfaces or edges to support a lateral side of the foot. In some instances, the distance from the first end 104 of the insole 102 to the second end 106 of the insole 102 may be about ¾ a length of the foot. In other instances, the insole 102 may extend the entire length of the foot. In some instances, a thickness of the second end 106 of the insole 102 may decrease in a direction away from the heal support portion 120. The insole 102 may be configured to be positioned within footwear, such as a shoe or the like.

In some instances, a cushion 124 may be positioned at the first end 104 of the insole 102 and on the upper surface 112 of the insole 102 for cushioning the heel of the foot. The cushion 124 may be molded into the insole 102, or the cushion 124 may be removably attached to the insole 102. In some instances, the cushion 124 may be glued or the like to the insole 102. Other fastening means may be used. The cushion 124 may be made of the same or a softer material than the insole 102. In certain embodiments, the cushion 124 may overlay the upper surface 112 of the insole 102. In other instances, the upper surface 112 of the insole 102 at the first end 104 of the insole 102 may include a cushion notch 126. The cushion notch 126 may be sized and shaped to receive the cushion 124 therein. That is, the cushion 124 may nest within the cushion notch 126. In one example, the cushion 124 may nest within the cushion notch 126 such that the cushion 124 is substantially flush with the upper surface 112 of the insole 102. In other instances, the cushion 124 may extend beyond the upper surface 112 of the insole 102. In certain embodiments, the orthotic device 100 may include an opening 128 between the upper surface 112 of the insole 102 and the lower surface 114 of the insole 102 about the first end 104 of the insole 102. At least a portion of the cushion 124 may be insertable into the opening 128. In certain embodiments, the cushion 124 may be angled relative to the upper surface 112 of the insole 102 to correct over pronation or supination of the foot.

In some instances, a second cushion, such as a metatarsal protrusion 132, may be positioned at the second end 106 of the insole 102 and on the upper surface 112 of the insole 102 for cushioning or supporting the metatarsal arch of the foot. The metatarsal protrusion 132 may be molded into the insole 102, or the metatarsal protrusion 132 may be removably attached to the insole 102. In some instances, the metatarsal protrusion 132 may be glued or the like to the insole 102. Other fastening means may be used. The metatarsal protrusion 132 may be made of the same or a softer material than the insole 102. In certain embodiments, the metatarsal protrusion 132 may overlay the upper surface 112 of the insole 102. In other instances, the upper surface 112 of the insole 102 at the second end 106 of the insole 102 may include a metatarsal protrusion notch 148. The metatarsal protrusion notch 148 may be sized and shaped to receive the metatarsal protrusion 132 therein. That is, the metatarsal protrusion 132 may nest within the metatarsal protrusion notch 148. In one example, the metatarsal protrusion 132 may nest within the metatarsal protrusion notch 148 such that the metatarsal protrusion 132 is substantially flush with the upper surface 112 of the insole 102. In other instances, the metatarsal protrusion 132 may extend beyond the upper surface 112 of the insole 102. In certain embodiments, the orthotic device 100 may include an opening 150 between the upper surface 112 of the insole 102 and the lower surface 114 of the insole 102 about the second end 106 of the insole 102. In some instances, at least a portion of the metatarsal protrusion 132 may be inserted into the opening 150. The opening 150 may facilitate insertion and/or removal of the metatarsal protrusion 132. In certain embodiments, the metatarsal protrusion 132 may be angled relative to the upper surface 112 of the insole 102 to correct over pronation or supination of the foot.

The orthotic device 100 also may include a removable angle insert 130 attachable to the lower surface 114 of the insole 102. The removable angle insert 130 increases an angle about the first side 108 of the insole 102 on a medial side of the foot to correct over pronation of the foot. In some instances, the removable angle insert 130 increases the angle about the first side 108 of the insole 102 on the medial side of the foot between about 0 to 10 degrees to correct over pronation of the foot. The removable angle insert 130 may increase the angle about the first side 108 of the insole 102 any amount (including those greater than 10 degrees) to correct over pronation of the foot.

In certain embodiments, a number of removable angle inserts 130 may provide varying angles about the first side 108 of the insole 102 on the medial side of the foot to correct over pronation of the foot. In this manner, depending on the needs of a user, the removable angle insert 130 may be swapped out with other angle inserts 130 to achieve a desired angle to correct over pronation of the foot. That is, the orthotic device 100 is customizable by a user to adjust the angle to correct (or resist) over pronation of the foot. The size and shape of the removable angle inserts 130 may vary to provide a different angle about the first side 108 of the insole 102 on the medial side of the foot to correct over pronation of the foot. For example, certain removable angle inserts 130 may be thinker or thinner than others so as to increase or decrease the angle about the first side 108 of the insole 102 on the medial side of the foot.

In some instances, the orthotic device 100 may include an insert notch 134 in the lower surface 114 of the insole 102 about the first end 104 of the insole 102 and along the first side 108 of the insole 102. The insert notch 134 may be sized and shaped to at least partially receive the removable angle insert 130 therein. The outline of the insert notch 134 may correspond to the shape of the removable angle insert 130. In this manner, the removable angle insert 130 may at least partially nest within the insert notch 134. In some instances, a lip 136 may extend at least partially about the insert notch 134. When positioned within the insert notch 134, the removable angle insert 130 may at least partially extend beyond the lip 136.

The removable angle insert 130 may include a heal portion 138 attachable to the lower surface 114 of the insole 102 about the first end 104 of the insole 102. Moreover, the removable angle insert 130 may include an extension portion 140 that extends from the heal portion 138 and is attachable to the lower surface 114 of the insole 102 along the first side 108 of the insole 102. In some instances, the extension portion 140 may be curved. For example, the extension portion 140 may curve towards the medial. Moreover, a contour of the extension portion 140 may correspond to a contour of the lower surface 114 of the insole 102. In some instances, a thickness of the extension portion 140 may decrease from the heal portion 138 outward. Likewise, a width of the extension portion 140 may decrease from the heal portion 138 outward.

The removable angle insert 130 is attachable to the lower surface 114 of the insole 102. That is, the removable angle insert 130 may be attached and detached from the lower surface 114 of the insole 102, such as within the insert notch 134. The positioning of the removable angle insert 130 about the lower surface 114 of the insole 102 creates the angle about the first side 108 of the insole 102 on the medial side of the foot, which corrects over pronation of the foot. Any attachment means may be used to removably secure the angle insert 130 to the insole 102. For example, the removable angle insert 130 may be mechanically fastened to the lower surface 114 of the insole 102. In an example embodiment, one or more protrusions 142 may be disposed along an edge 144 of the removable angle insert 130. Similarly, one or more slots 146 may be disposed along the lower surface 114 of the insole 102, such as within the inter notch 134. The protrusions 142 may be configured to mate with the slots 146 to secure the removable angle insert 130 to the lower surface 114 of the insole 102.

Although FIGS. 1-10 depict the orthotic device 100 with respect to correcting pronation, one of ordinary skill in the art will appreciate that the location and angles of the removable angle insert 130 and the insert notch 134 may be reconfigured (e.g., mirror images of the pronation configuration) to correct supination. That is, the size and shape of the removable angle inserts 130 and insert notch 134 may vary to provide a different angle about the second side 110 of the insole 102 on the lateral side of the foot to correct over supination of the foot. For example, the insert notch 134 may be disposed about the lower surface 114 of the insole 102 about the first end 104 of the insole 102 and along the second side 110 of the insole 102. Likewise, the extension portion 140 of the removable angle insert 130 may extend from the heal portion 138 along the second side 110 of the insole 102.

Figure 11:
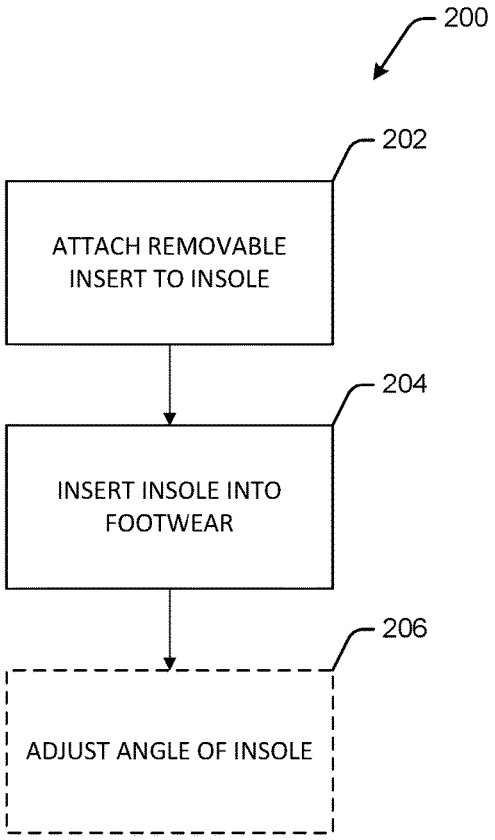
FIG. 11 is a flow diagram depicting an illustrative method to correct over pronation or supination of the foot in accordance with one or more embodiments of the disclosure.

FIG. 11 is a flow diagram depicting an illustrative method 200 to correct over pronation or supination of the foot in accordance with one or more embodiments of the disclosure. At block 202 of the method 200, the removable angle insert 130 may be attached to the lower surface 114 of the insole 102. For example, the removable angle insert 130 may be disposed within the insert notch 134. For pronation, the removable angle insert 130 increases the angle about the first side 108 of the insole 102 on the medial side of the foot to correct over pronation of the foot. For supination, the removable angle insert 130 increases the angle about the second side 110 of the insole 102 on the lateral side of the foot to correct over supination of the foot. At block 204 of the method 200, the insole 102 (with the removable angle insert 130 attached thereto) may be inserted into footwear. At block 206 of the method 200, a user may adjust the angle about the first side 108 of the insole 102 on the medial side of the foot by replacing the removable angle insert 130 with another removable angle insert 130 of different dimensions (such as thickness) to increase or decrease the angle about the first side 108 of the insole 102 on the medial side of the foot. Alternatively, a user may adjust the angle about the second side 110 of the insole 102 on the lateral side of the foot by replacing the removable angle insert 130 with another removable angle insert 130 of different dimensions (such as thickness) to increase or decrease the angle about the second side 110 of the insole 102 on the lateral side of the foot.

The steps described in blocks 202-206 of method 200 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A customizable orthotic device for insertion into footwear for correcting over pronation or supination of a foot, the orthotic device comprising:

an insole comprising an upper surface and a lower surface, wherein the upper surface of the insole receives and supports at least a portion of the foot;

a plurality of removable angle inserts at least one of which is attachable to the lower surface of the insole at a time, wherein the plurality of removable angle inserts increase an angle about a side of the insole to correct over pronation or supination of the foot, wherein each of the plurality of removable angle inserts provide varying angles about the side of the insole to correct over pronation or supination of the foot, wherein the plurality of removable angle inserts enable a user to customize the customizable orthotic device to correct over pronation or supination of the foot;

an insert notch in the lower surface of the insole, wherein the insert notch is sized and shaped to at least partially receive at least one of the plurality of removable angle inserts therein;

one or more protrusions along an edge of each of the plurality of removable angle inserts; and one or more slots along the lower surface of the insole within the insert notch, wherein the one or more protrusions are configured to mate with the one or more slots to secure the plurality of removable angle inserts to the lower surface of the insole within the insert notch.

2. The orthotic device of claim 1, wherein the insole comprises a first end, a second end, a first side, and a second side.

3. The orthotic device of claim 2, wherein the plurality of removable angle inserts increase the angle about the first side of the insole between about 0 to 10 degrees on the medial side of the foot to correct over pronation of the foot.

4. The orthotic device of claim 2, wherein the first end of the insole comprises a heel support portion having a contoured surface that corresponds to a heel of the foot, and the first side of the insole comprises an arch support portion having a contoured surface that corresponds to an arch of the foot.

5. The orthotic device of claim 2, further comprising a cushion positioned at the first end of the insole and on the upper surface of the insole for cushioning a heel of the foot.

6. The orthotic device of claim 5, further comprising a cushion notch in the upper surface of the insole about the first end of the insole, wherein the cushion notch is sized and shaped to receive the cushion therein.

7. The orthotic device of claim 5, further comprising an opening between the upper surface of the insole and the lower surface of the insole about the first end of the insole, wherein at least a portion of the cushion is insertable into the opening.

8. The orthotic device of claim 5, wherein the cushion is angled relative to the upper surface of the insole to correct over pronation of the foot.

9. The orthotic device of claim 2, wherein a thickness of the insole decreases about the second end of the insole.

10. The orthotic device of claim 2, wherein the insert notch is disposed about the first end of the insole and the first side of the insole.

11. The orthotic device of claim 10, further comprising a lip that extends at least partially about the insert notch, wherein the at least one of the plurality of removable angle inserts at least partially extends beyond the lip.

12. The orthotic device of claim 2, wherein each of the plurality of removable angle inserts comprise:

a heel portion attachable to the lower surface of the insole about the first end of the insole; and an extension portion that extends from the heel portion and is attachable to the lower surface of the insole along the first side of the insole.

13. The orthotic device of claim 12, wherein the extension portion is curved.

14. The orthotic device of claim 12, wherein a contour of the extension portion corresponds to a contour of the lower surface of the insole.

15. The orthotic device of claim 2, further comprising a metatarsal protrusion positioned at the second end of the insole and on the upper surface of the insole for cushioning or supporting the metatarsal arch of the foot.

16. A method for customizing and orthotic device for insertion into footwear for correcting over pronation or supination of a foot, the method comprising:

providing an insole comprising a first end, a second end, a first side, a second side, an upper surface, and a lower surface, wherein the upper surface of the insole receives and supports at least a portion of the foot; and providing a plurality of removable angle inserts at least one of which is attachable to the lower surface of the insole at a time, wherein the plurality of removable angle inserts increases an angle about the first side or the second side of the insole to correct over pronation or supination of the foot, wherein each of the plurality of removable angle inserts provide varying angles about the first side or the second side of the insole to correct over pronation or supination of the foot, wherein the plurality of removable angle inserts enable a user to customize the orthotic device to correct over pronation or supination of the foot, wherein an insert notch is disposed in the lower surface of the insole, wherein the insert notch is sized and shaped to at least partially receive at least one of the plurality of removable angle inserts therein, wherein one or more protrusions are disposed along an edge of each of the plurality of removable angle inserts, wherein one or more slots are disposed the lower surface of the insole within the insert notch, wherein the one or more protrusions are configured to mate with the one or more slots to secure the plurality of removable angle inserts to the lower surface of the insole within the insert notch.

* * * * *